US006917767B2

(12) United States Patent
Kabashima

(10) Patent No.: US 6,917,767 B2
(45) Date of Patent: Jul. 12, 2005

(54) IMAGE FORMING APPARATUS, FEATURING A TIME-CONTROLLED TONER REPLENISHING OPERATION

(75) Inventor: Toru Kabashima, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 22 days.

(21) Appl. No.: 10/327,149

(22) Filed: Dec. 24, 2002

(65) Prior Publication Data

US 2003/0128992 A1 Jul. 10, 2003

(30) Foreign Application Priority Data

Dec. 28, 2001 (JP) ..... 2001/400645

(51) Int. Cl.[7] ..... G03G 15/08; G03G 15/10
(52) U.S. Cl. ..... 399/27; 399/61; 399/258
(58) Field of Search ..... 399/27, 53, 58, 399/61, 258, 260, 262, 263

(56) References Cited

U.S. PATENT DOCUMENTS 5,802,419 A * 9/1998 Sakurai et al. ..... 399/27 X
5,826,134 A * 10/1998 Hino et al. ..... 399/27
6,016,408 A * 1/2000 Hashimoto et al. ..... 399/27
6,343,193 B1 * 1/2002 Matsumoto et al. ..... 399/27
6,381,421 B1 * 4/2002 Katahira ..... 399/27
6,501,933 B2 * 12/2002 Ishii ..... 399/27 X
6,567,622 B2 * 5/2003 Phillips ..... 399/27 X
2001/0004423 A1 * 6/2001 Kakeshita et al. ..... 399/27 X

FOREIGN PATENT DOCUMENTS

JP 5-35098 2/1993
JP 8-339118 12/1996

* cited by examiner

*Primary Examiner*—Sandra Brase
(74) *Attorney, Agent, or Firm*—Fitzpatrick, Cella, Harper & Scinto

(57) ABSTRACT

In case the output of an antenna member does not return to a first level even after an execution of a toner replenishing operation for a predetermined period from a state where an image forming operation is prohibited, the toner replenishing operation is terminated. Such configuration avoids an unnecessary idle rotation of a developing device at the replacement of the developing device or in case an empty toner cartridge is mounted again on an image forming apparatus, thereby suppressing drawbacks such as an image fog or an image density loss.

8 Claims, 13 Drawing Sheets

FIG. 5

RELATION BETWEEN RESIDUAL DEVELOPER AMOUNT IN DEVELOPING DEVICE AND ELECTROSTATIC CAPACITY OR INDUCED VOLTAGE

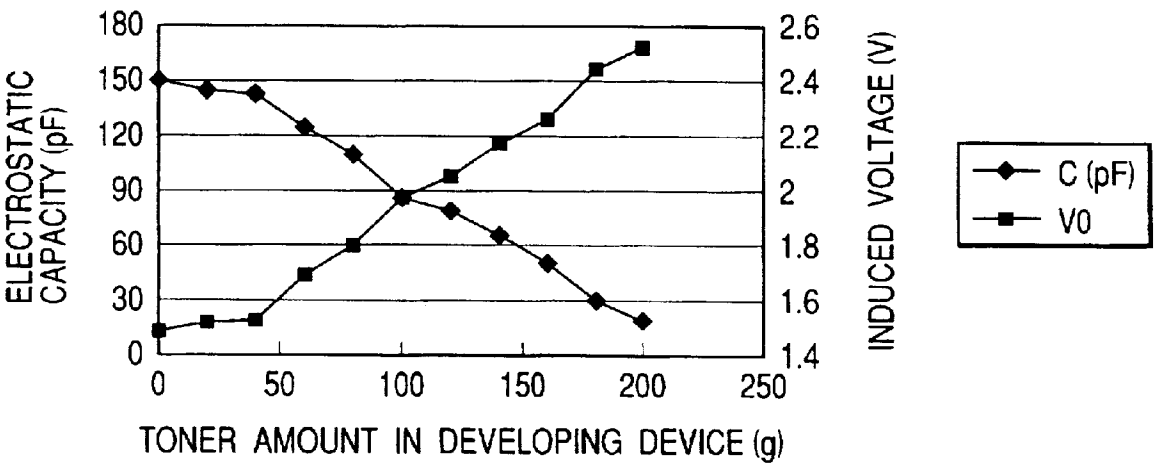

EXAMINATION CONDITIONS

- ENVIRONMENT : TEMPERATURE 25℃, HUMIDITY 60%, IDLE ROTATION FOR ONE MINUTE AFTER DEVELOPER REPLENISHMENT
- DEVELOPING BIAS : Vpp 1.5kv, FREQUENCY 2.0Hz
- ELECTRIC FIELD INTENSITY : 1.06V/$\mu$
- MAXIMUM PROXIMATE DISTANCE BETWEEN SLEEVE AND ANTENNA MEMBER : 5.0mm

RELATION BETWEEN MAXIMUM PROXIMATE DISTANCE OF SLEEVE / ANTENNA MEMBER AND ELECTROSTATIC CAPACITY OR UNEVENNESS OF INDUCED VOLTAGES

EXAMINATION CONDITIONS

- ENVIRONMENT : TEMPERATURE 25℃, HUMIDITY 60%, IDLE ROTATION FOR ONE MINUTE AFTER DEVELOPER REPLENISHMENT
- TONER AMOUNT IN DEVELOPING DEVICE : 100g

INDUCED VOLTAGE SIGNAL VALUE BY IMAGE RATIO DIFFERENCE

EXAMINATION CONDITIONS

- ENVIRONMENT : TEMPERATURE 25℃, HUMIDITY 60%
- DEVELOPER AMOUNT IN DEVELOPING DEVICE : 100g
- ELECTRIC FIELD INTENSITY : 1.06V/μ
- MAXIMUM PROXIMATE DISTANCE BETWEEN SLEEVE AND ANTENNA MEMBER : 5.0mm

VARIATION OF IMAGE DENSITY BY DIFFERENCE OF DEVELOPER AMOUNT ON REPLENISHMENT

EXAMINATION CONDITIONS

- ENVIRONMENT : TEMPERATURE 25℃, HUMIDITY 60%
- ELECTRIC FIELD INTENSITY : 1.06V/ $\mu$
- MAXIMUM PROXIMATE DISTANCE BETWEEN SLEEVE AND ANTENNA MEMBER : 5.0mm

VARIATION OF IMAGE FOG BY DIFFERENCE OF DEVELOPER AMOUNT ON REPLENISHMENT

EXAMINATION CONDITIONS

- ENVIRONMENT : TEMPERATURE 25℃, HUMIDITY 60%
- ELECTRIC FIELD INTENSITY : 1.06V/μ
- MAXIMUM PROXIMATE DISTANCE BETWEEN SLEEVE AND ANTENNA MEMBER : 5.0mm

VARIATION OF INDUCED VOLTAGE VALUE BY DIFFERENCE OF COHESIVE DEGREE OF TONER IN DEVELOPER CONTAINER ON REPLENISHMENT

EXAMINATION CONDITIONS

- ENVIRONMENT : TEMPERATURE 25℃, HUMIDITY 60%
- ELECTRIC FIELD INTENSITY : 1.06V/μ
- DEVELOPER AMOUNT ON REPLENISHMENT : 100g
- MAXIMUM PROXIMATE DISTANCE BETWEEN SLEEVE AND ANTENNA MEMBER : 5.0mm

VARIATION OF DENSITY AGAINST IDLE ROTATION TIME

EXAMINATION CONDITIONS

- ENVIRONMENT : TEMPERATURE 25℃, HUMIDITY 60%
- ELECTRIC FIELD INTENSITY : 1.06V/$\mu$
- MAXIMUM PROXIMATE DISTANCE BETWEEN SLEEVE AND ANTENNA MEMBER : 5.0mm

VARIATION OF DENSITY AGAINST IDLE ROTATION TIME

EXAMINATION CONDITIONS

- ENVIRONMENT : TEMPERATURE 25°C, HUMIDITY 60%
- ELECTRIC FIELD INTENSITY : 1.06V/μ
- MAXIMUM PROXIMATE DISTANCE BETWEEN SLEEVE AND ANTENNA MEMBER : 5.0mm

IMAGE FORMING APPARATUS, FEATURING A TIME-CONTROLLED TONER REPLENISHING OPERATION

BACKGROUND OF THE INVENTION

1. Field of the Invention

The present invention relates to an image forming apparatus utilizing an electrophotographic method, and more particularly to an image forming apparatus such as a copying apparatus, a printer or a facsimile apparatus.

2. Related Background Art

A developing apparatus is conventionally positioned around an image bearing member on which an electrostatic latent image is formed by a primary electrostatic charging device, an exposure apparatus and the like, and cleaning means for removing and recovering a developer remaining on the image bearing member.

In the developing apparatus, there is provided a developer carrying member for causing the developer in such developing apparatus to fly to the image bearing member, and such developer carrying member is provided in a position almost contacting the image bearing member in order to form the electrostatic latent image on the image bearing member into a visible image. On the developer carrying member, there is formed a developer layer of a predetermined thickness by a developing blade. In the developing apparatus, there are provided an agitating member for agitating and carrying the developer toward the developer carrying member, and an antenna member for detecting a remaining amount of the developer.

For the developing apparatus, it is very important to detect the amount of the developer therein. In case the developer is exhausted suddenly, white streaks or white stripes are generated on the image, thereby giving an unpleasant feeling to the user. It is therefore necessary to detect the amount of the developer in the developing apparatus by suitable means and to transmit the result of such detection to the user.

For achieving a compactization of the developing apparatus, a cartridge configuration and a lower running cost, it is desirable to utilize the aforementioned antenna member, rather than a piezoelectric element which converts a pressure of the developer into a voltage.

For a detecting method utilizing such antenna member (hereinafter called antenna method), there is known a method of detecting a voltage induced in the antenna member and comparing the induced voltage with a reference voltage to judge the necessity of the developer replenishment, thereby outputting an instruction.

On the other hand, Japanese Patent Application Laid-open No. 5-35098 proposes a detection method utilizing a developing blade which is capable of detecting the remaining amount with a lower cost, but such method is unsuitable for a more precise detection of the amount of the developer, since this method shows a very large fluctuation in the induced voltage with respect to the developer amount, in comparison with the antenna method.

Also Japanese Patent Application Laid-open No. 8-339118 proposes means for detecting the developer amount in the developing apparatus by a detection method utilizing two reference voltages in the antenna method (hereinafter called 2-step detection method) and forecasting a timing of replenishment.

However, such two-step detection method is associated with a drawback that, in case of rotating an agitating rod and a developing sleeve in order to replenish the developing apparatus with the developer, the agitating rod and the developing sleeve are rotated even in the absence of the developer, thereby resulting in a loss in the density, a deterioration of the developer, an image fog or the like. Also there may result an erroneous display since the copying operation is rendered possible as soon as the second reference signal is reached.

SUMMARY OF THE INVENTION

An object of the present invention is to provide an image forming apparatus capable of preventing a loss in the image density, a deterioration in the developer, an image fog generation and the like resulting from the toner replenishing operation.

Other objects of the present invention will become fully apparent from the following detailed description which is to be taken in conjunction with accompanying drawings.

BRIEF DESCRIPTION OF THE DRAWINGS

FIG. 5 is a chart showing a relationship between a developer amount in a developing device and an electrostatic capacity or an induced voltage;

DESCRIPTION OF THE PREFERRED EMBODIMENTS

In the following there will be explained embodiments of the present invention with reference to the accompanying drawings.

Figure 1:
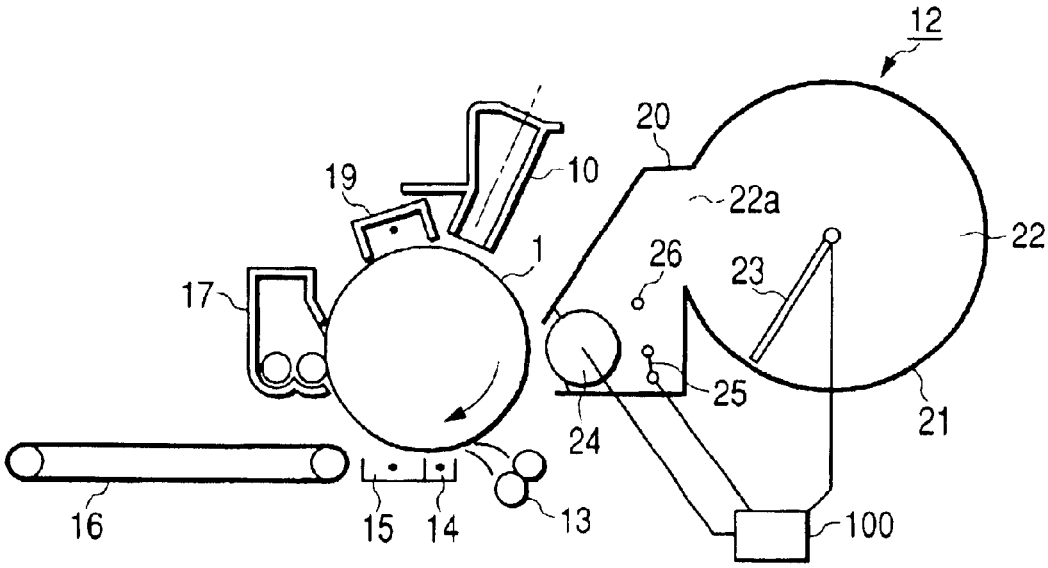
FIG. 1 is a cross-sectional view of a principal part of an image forming apparatus of the present invention.

FIG. 1 is a cross-sectional view of a principal part of an image forming apparatus of the present invention, wherein the illustrated image forming apparatus is a composite apparatus (or multi function machine).

Referring to FIG. 1, above an image bearing member 1, there is provided an exposure apparatus 10. The exposure apparatus 10 is composed of an unrepresented fixed original table, an original illuminating lamp, a CIS sensor, etc.

Around the image bearing member 1 and along the rotating direction thereof, there are provided various process devices. More specifically, in a position above the image bearing member 1, a primary charging device 19 is provided for uniformly charging the surface of the image bearing member 1. Also in a position lateral to the image bearing member, there is provided a developing apparatus 12, which renders visible the electrostatic latent image on the image bearing member 1 with toner serving as a developer.

Also in a position under the image bearing member, there are provided a pair of timing rollers 13 for aligning a transfer material (transfer sheet), conveyed from an unrepresented sheet feeding portion, with a developer image formed by development on the image bearing member 1, a transfer charging device 14 for transferring the developer image formed on the image bearing member 1 onto the transfer sheet, and a separating charging device 15 for separating the transfer sheet from the image bearing member 1. In a position adjacent to the separating charger 15, a conveyor belt 16 for conveying the transfer sheet to an unrepresented fixing device. Also in a position above the conveyor belt 16 and at a side of the image bearing member 1, there is provided cleaning means 17 for removing a residual developer which remains on the image bearing member 1 without being transferred onto the transfer sheet.

In the following there will be explained details of the developing apparatus 12.

The developing apparatus 12 incorporates therein a developing device 20, a developer container 21 positioned obliquely above the developing device 20 and constituting a toner replenishing container which is detachably mounted on a mounting portion of the developing device 20, a carrying member 23 for carrying the toner to the developing device, a developer carrying member 24, and a voltage detecting member 26.

In a developer discharge aperture, close to the image bearing member 1, of the developing device 20, there is rotatably provided a developing carrying member (hereinafter called developing sleeve) 24 incorporating therein an unrepresented magnet. The aforementioned developer container 21 is provided with a developer chamber 22 containing the developer, and the developer chamber 22 is provided with a rotary carrying member 23 for scraping the developer to the developing device 20 through an aperture 22*a* of the developer chamber 22. Also, inside the developing device 20, there is provided an agitating member 25 having a rotary axis parallel to that of the developing sleeve 24, and such agitating member 25 has functions of agitating the developer and carrying the developer toward the developing sleeve 24. The rotation of the developing sleeve 24, the carrying member 23 and the agitating member 25 is achieved by common drive means (driving motor 100, so that the carrying member 23 and the agitating member 25 are automatically rotated when the developing sleeve 24 is rotated.

Figure 4:
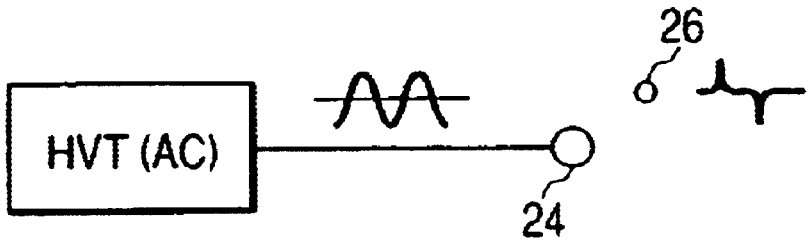
FIG. 4 is a circuit diagram showing developer amount calculation means for processing an induced voltage in the image forming apparatus of the present invention.

Furthermore, inside the developing device 20, a conductive voltage detecting member (hereinafter called antenna member) 26 is provided close to the developing sleeve 24. In the antenna member 26, a voltage is induced based on developing biases 33, 35 (cf. FIG. 2) applied to the developing sleeve 24. FIG. 4 shows a relationship of the developing biases 33, 35, the developing sleeve 24 and the antenna member 26.

Figure 2:
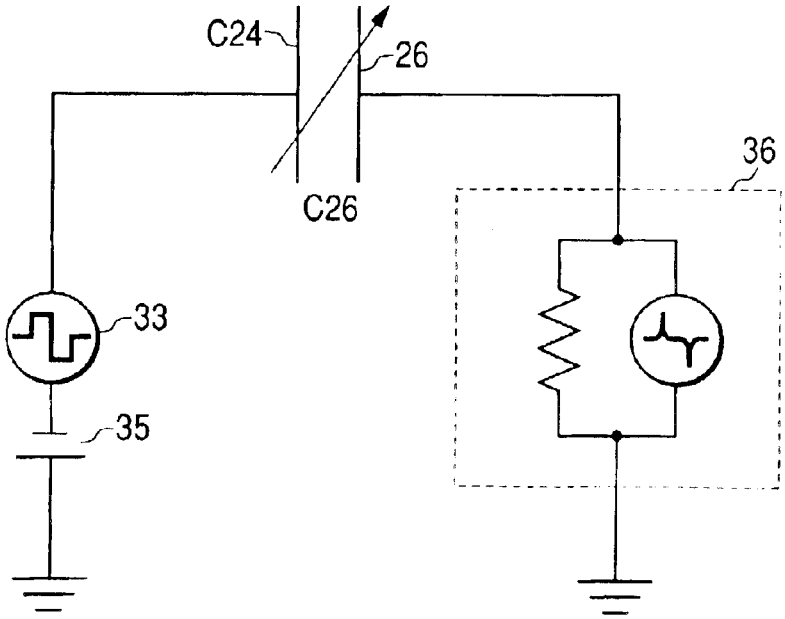
FIG. 2 is an equivalent circuit diagram showing a developing sleeve and a voltage detecting member in the image forming apparatus of the present invention.
Figure 3:
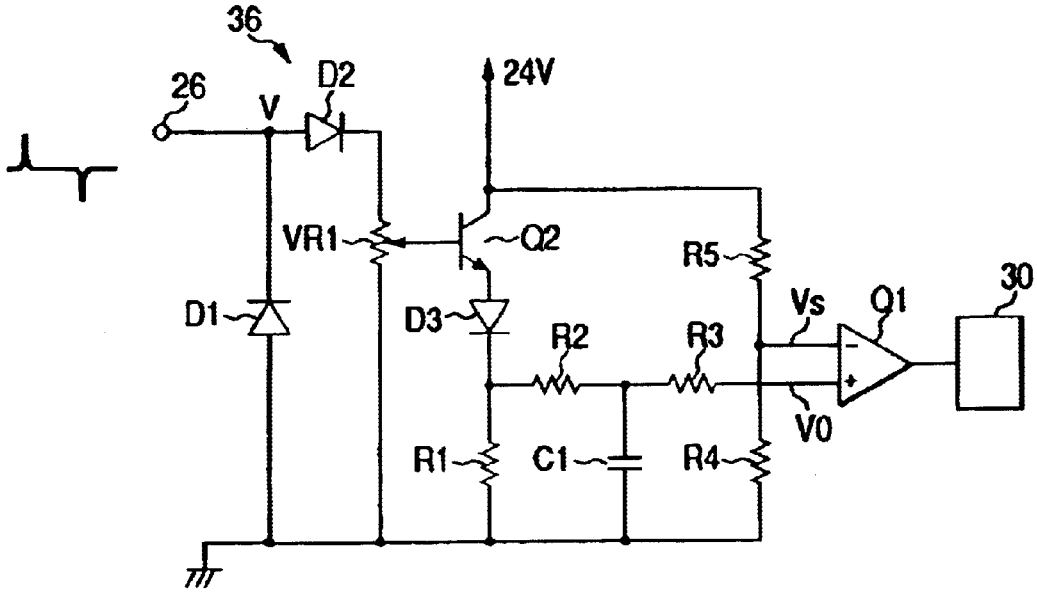
FIG. 3 is a circuit diagram showing developer amount calculation means for processing an induced voltage of the voltage detecting member in the image forming apparatus of the present invention.

In the following there will be explained, with reference to FIGS. 2 and 3, developer amount calculation means 36 for calculating the developer amount utilizing the antenna member 26. FIG. 2 is an equivalent circuit diagram of the developing sleeve and the antenna member, and FIG. 3 is a circuit diagram of the developer amount calculation means.

When developing biases 33, 35 are applied to the developing sleeve 24, a voltage V is induced in the antenna member 26 depending on the dielectric constant of an electrostatic capacity of a capacitor C26 constituted by the developing sleeve 24 and the antenna member 26.

FIG. 5 is a chart showing a relationship between the above-mentioned electrostatic capacity and the amount of the developer in the developing device.

It will be understood that the electrostatic capacity changes according to the amount of the developer in the developing device. The dielectric constant and the electrostatic capacity increase as the amount of the developer becomes smaller. Also it will be understood that the voltage induced in the antenna member 26 becomes lower as the amount of the developer becomes smaller.

The induced voltage is processed by developer amount calculation means 36 shown in FIG. 3, whereby a display device 30 displays the remaining amount of the developer in the developing device 20 or the presence or absence of necessity of the developer replenishment. In FIG. 2, the developing bias is obtained by a combination of an alternating power source 33 and a DC power source 35, and a capacitor C24 represents the developing sleeve 24 as an electrode of the capacitor C26. In an example of the developing bias, the alternating power source 33 provides a sinusoidal or rectangular wave for example 2000 Hz and 1300 V. diagram of the developer amount calculation means.

The developer amount calculation means 36 processes the voltage induced in the antenna member 26, thereby detecting the presence or absence of necessity for the developer replenishment. The developer amount calculation means 36 is formed by a rectifying circuit composed of diodes D1, D2, an impedance conversion circuit composed of a variable resistor VR1, a resistor R1, a diode D3, and a transistor Q2, and a smoothing circuit composed of a capacitor C1, and resistors R2, R3.

The induced voltage generated in the antenna member 26 is rectified by the rectifying circuit, then subjected to an impedance conversion by the variable resistor VR1, the resistor R1 and the transistor Q2, and smoothed by the smoothing circuit R2, R3, and C1 to provide a developer remaining amount detection signal (hereinafter called remainder detection signal) V0. A reference signal Vs is generated by voltage dividing resistors R4 and R5. Then the remainder detection signal V0 is compared with a reference signal Vs by a comparator Q1 to discriminate whether the remaining amount of the developer is larger or smaller than a reference remaining amount, and a result of comparison is displayed on the display device 30.

Figure 6:
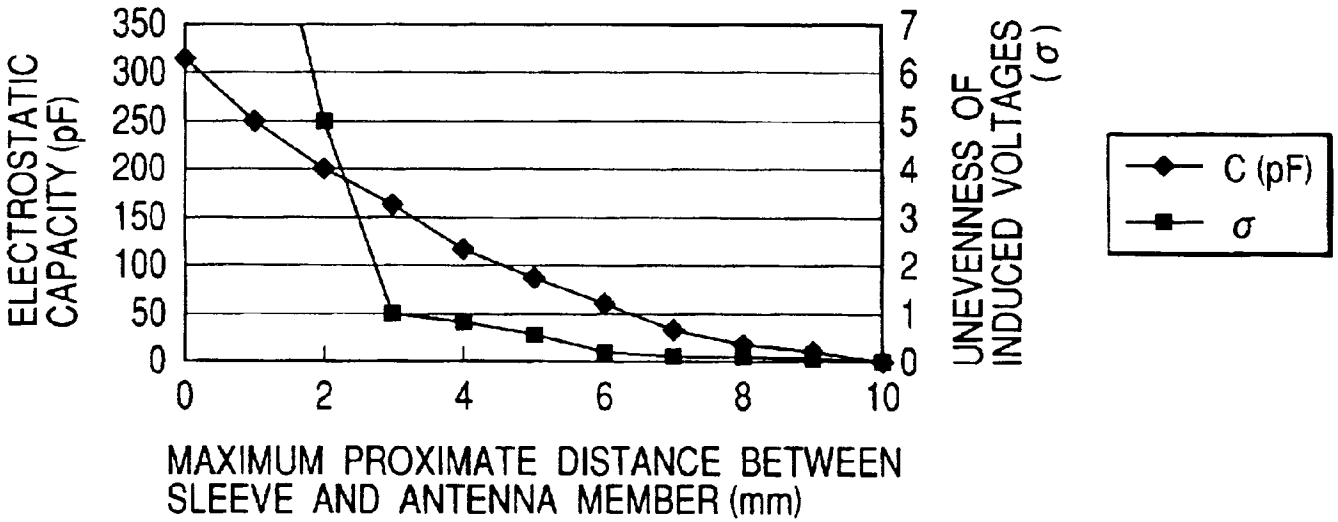
FIG. 6 is a chart showing a relationship between a maximum proximate distance of the developing sleeve and the antenna member, and an electrostatic capacity or an unevenness in the induced voltage.

FIG. 6 shows a relationship between a distance of the antenna member 26 and the developing sleeve 24, and the induced voltage.

FIG. 6 indicates that the electrostatic capacity becomes lower as the distance between the developing sleeve 24 and the antenna member 26 increases. In case the electrostatic capacity is low, the detection signal becomes smaller whereby the exact amount of the developer cannot be detected. On the other hand, in case the distance between the developing sleeve 24 and the antenna member 26 is small, the electrostatic capacity becomes higher but the detection of the exact developer amount is not possible because the induced voltage shows a very large fluctuation. Based on these results, the distance between the developing sleeve 24 and the antenna member 26 is desirably within a range from 3 to 6.5 mm. Such distance is however merely an example, and there may be present another optimum value depending on the developer, the developer carrying member and the developing conditions.

In the foregoing, it has been explained that the amount of the developer in the developing device 20 can be detected from the induced voltage, utilizing the developer amount calculation means 36. Now there will be explained a method of estimating the amount of the developer in the developer container 21.

Since the developer container 21 of the developing apparatus 12 is positioned obliquely above the developing device 20 and the aperture 21*a* of the developer container 21 communicates with the developing device 20, the developer carried by the carrying member 23 into the developing device 20 does not return to the developer container 21 when the amount of the developer stored in the developer container 21 is large.

However, as the amount of the developer stored in the developer container 21 decreases, the height of the developer carried by the carrying member 23 and stored in the developing device 20 may become larger than the height of the developer stored in the developer container 21, whereby a heap the developer in the developing device 20 may collapse and the developer may return to the developer container 21. Since such phenomenon occurs in a situation where the developer is stored in at least a certain amount and when the amount of the developer decreases, it is possible, by calculating the amount of the developer in the developing device 20, to estimate the remaining amount of the developer in the developer container 21 thereby detecting the entire remaining amount of the developer.

In the following there will be explained a 1-step detection method and a 2-step detection method.

In the 1-step detection method employing a single reference signal, when the induced voltage reaches the reference signal level, an immediate prohibition of the copying operation may give an unpleasant feeling to the user as the apparatus suddenly becomes unusable for the user. For this reason, a certain number of copyings is allowed in such situation.

Figure 7:
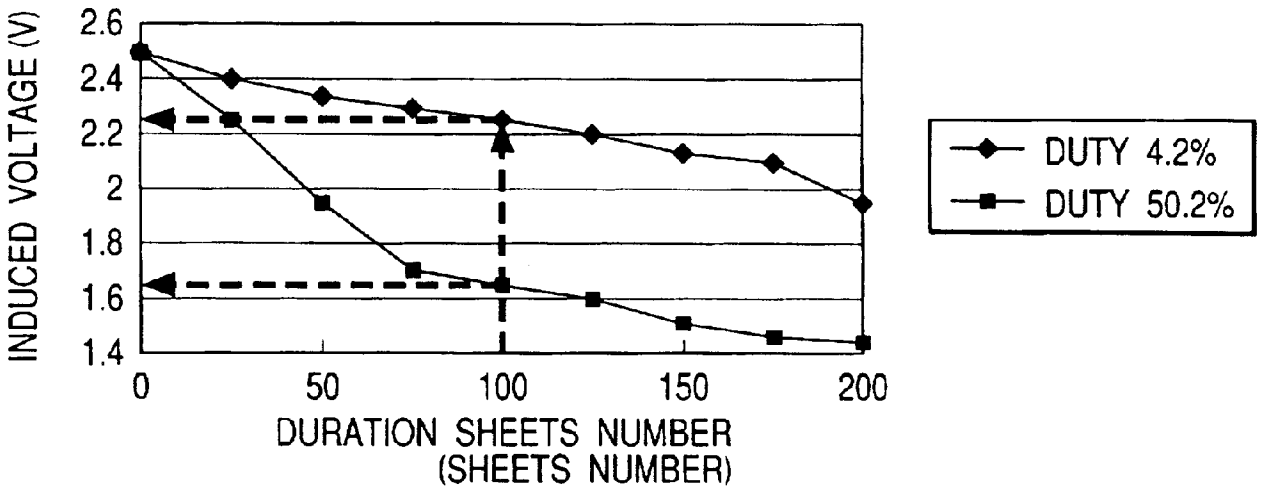
FIG. 7 is a chart showing a variation in the induced voltage in a durability test.

In the 1-step detection method, however, the remaining amount of the developer may fluctuate since the consumption of the developer, after the induced voltage reaches the reference signal level, varies depending on the user. FIG. 7 shows induced voltages in the 1-step detection method for different image ratios in a durability test. An image ratio of 50.2% results in, in comparison with an image ratio of 4.2%, a difference of 100 g in the amount of the developer in the developing device and a different of 0.6 V in the signal value.

Figure 8:
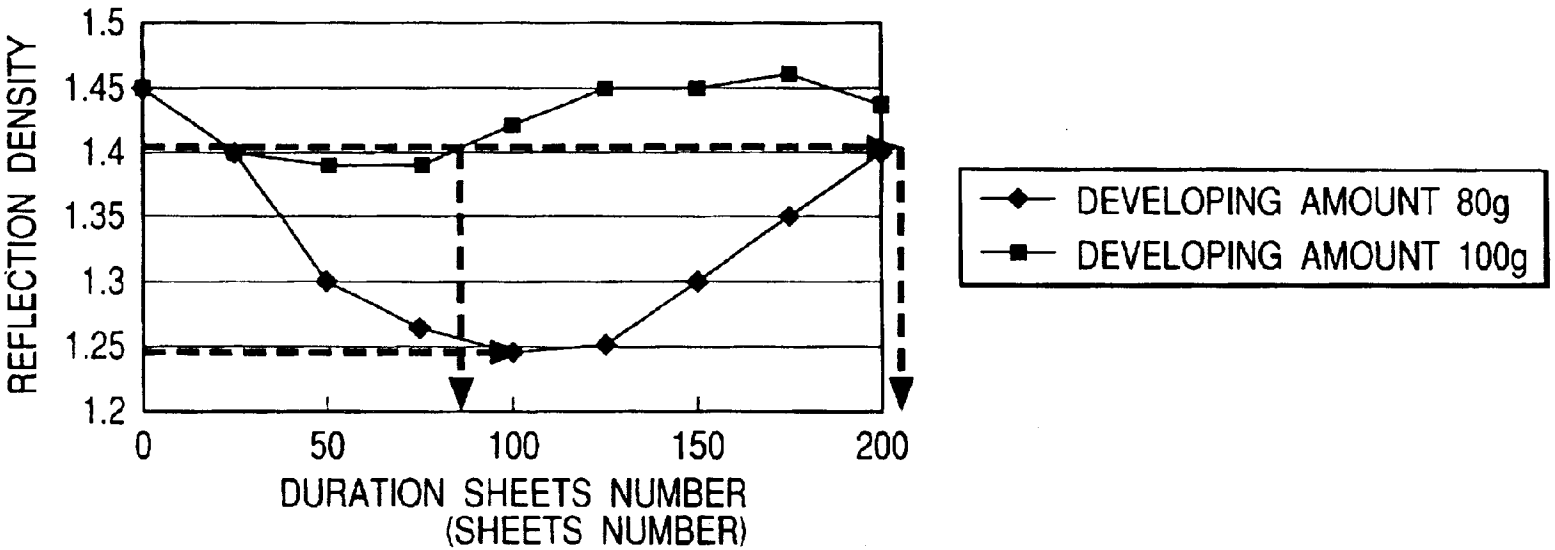
FIG. 8 is a chart showing a variation in the image density in a durability test.
Figure 9:
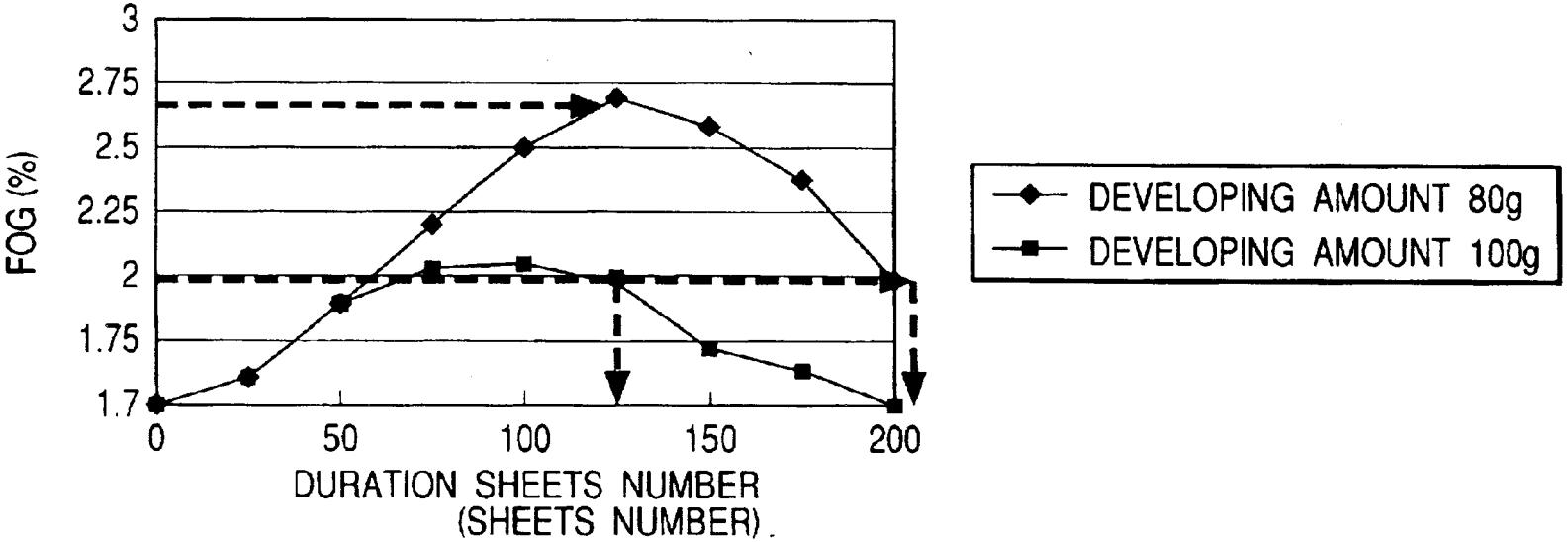
FIG. 9 is a chart showing a variation in the image fog in a durability test.

A difference in the amount of the developer in the developing device leads to an influence on the image (particularly a density loss or an increase in the image fog) immediately after the developer replenishment. FIG. 8 shows a variation in the density immediately after the replenishment, and FIG. 9 shows a variation in the image fog immediately after the replenishment. It will be seen that a density loss or a fog increase is observed in case the amount of the developer is extremely low. For example, a developer amount of 80 g, in comparison with a case of 100 g, causes a decrease of the reflective density by 0.15 and an increase of fog by 1.75%. Also the number of copies in the durable test required for restoring the initial density or fog is about 2 times in the density and about 1.6 times in the fog, in case of a developer amount of 80 g, in comparison with a case of 100 g.

Based on the foregoing description, it is necessary to maintain the remaining amount of the developer constant at the replenishment, in order to improve the image quality immediately after the replenishment.

On the other hand, the 2-step detection method is featured by utilizing two reference signals, namely a first reference signal and a second reference signal (larger than the first reference signal). At first, when the remaining amount of the developer becomes equal to or less than a first reference value, such situation is detected and an instruction is transmitted for showing a display for prohibiting the copying operation on a liquid display device provided in the image forming apparatus and showing a display for requesting a replenishment of the developer (hereinafter called prohibition judging means). Also when the remaining amount of the developer becomes equal to or larger than the first reference value but equal to less than a second reference value, such situation is detected and an instruction is transmitted for showing a display of a developer replenishment notice (requesting the user to replace the toner replenishing container with a new one) (hereinafter called alarm judging means). The "display" is not limited to a display on the display device provided in the image forming apparatus, but, in case the image forming apparatus is used as a network printer, the above-mentioned request to the user may be transmitted to a personal computer connected through the network.

As an example, by selecting the remaining developer amount at about 70 g for the alarm judging means and the remaining developer amount at 50 g for the prohibition judging means, there can be consumed the developer of about 20 g from the alarm display to the prohibition display. Since this developer amount allows to obtain 500 copies in a standard chart, the user can prepare a new replenishing developer in the meantime and can therefore execute the copying operation in an assured manner. Thus, the 2-step detection method utilizing the prohibition judging means and the alarm judging means can stabilize, in comparison with the 1-step detection method, the amount of the developer stored in the developing device, at the time of the prohibition.

However, the 2-step detection method involves drawbacks of causing a density loss or a fog in case the developer is absent in the replenishing developer container, as explained in the foregoing. This is caused, in the developer replenishment in the state of the alarm display in the 2-step detection method, by a fact that the replenishment is continued until the induced voltage reaches the second reference signal level. With such developer replenishment, it is known that the time required for reaching the first reference signal fluctuates according to an environmental condition or a state of the container.

Figure 10:
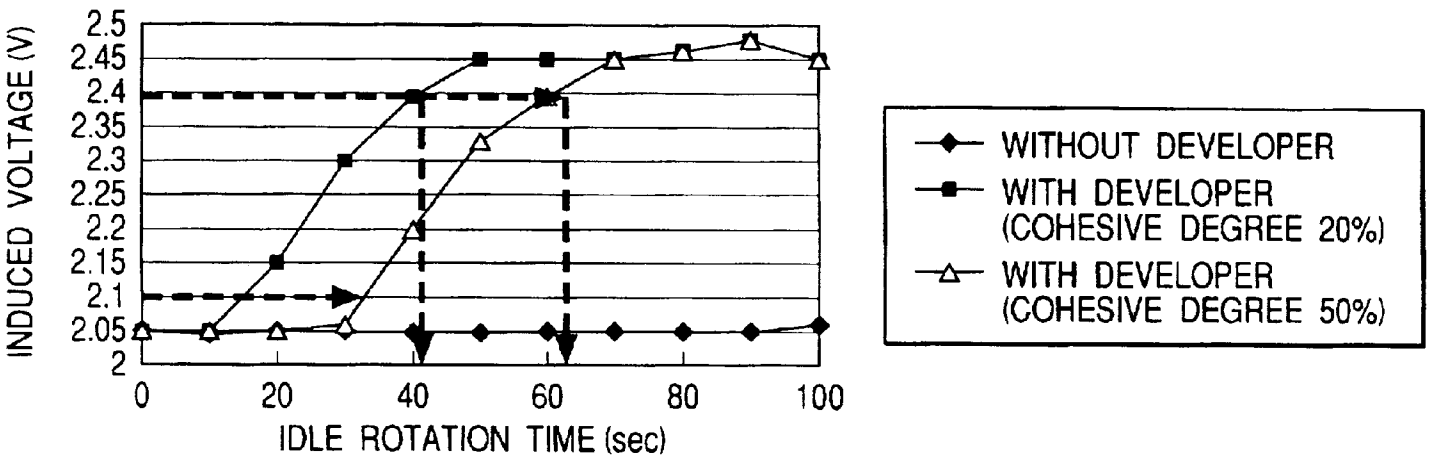
FIG. 10 is a chart showing a variation in the induced voltage by an idle rotation at the developer replenishment.

FIG. 10 shows a variation of the induced voltage depending on the state of the container. It can be observed that the increase of the induced voltage becomes slower as a level of cohesion (or cohesive degree), indicating the state of the developer in the container, is higher (for example in a low humidity environment). For example, an increase of the induced voltage by 0.35 requires a period of 1.5 times at a cohesion level (or cohesive degree) of 50%, in comparison with a case of a cohesion level of 20%. In the 2-step detection method, the maximum replenishing time is conventionally so determined as to execute a sufficient replenishment of the developer under a worst condition (high cohesion level) of the developer in the developer container.

Figure 11:
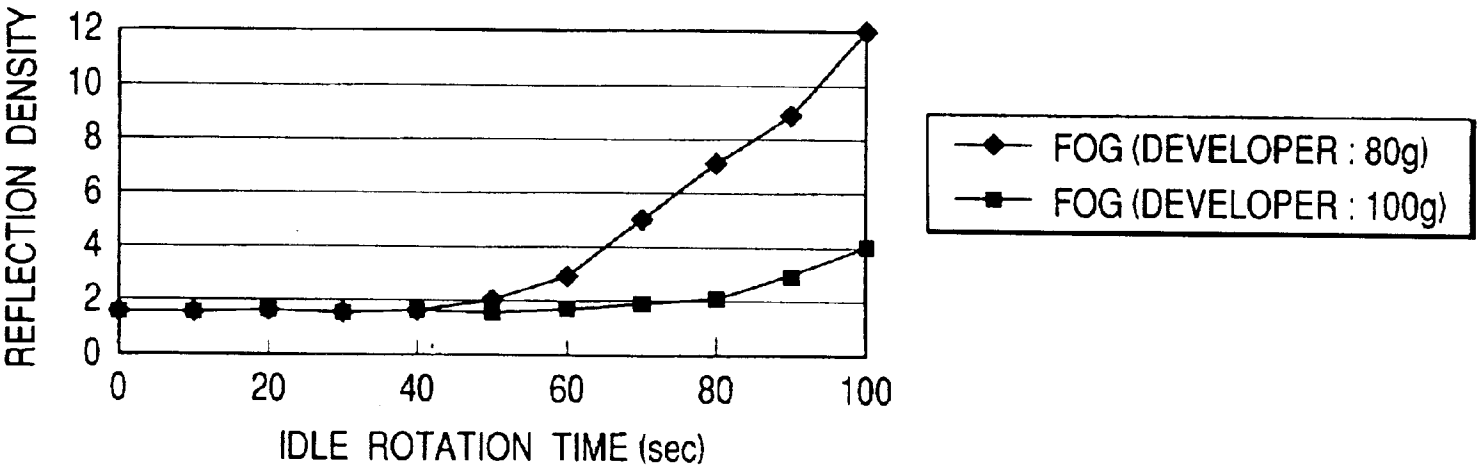
FIG. 11 is a chart showing a variation in the image fog by an idle rotation at the developer replenishment.
Figure 12:
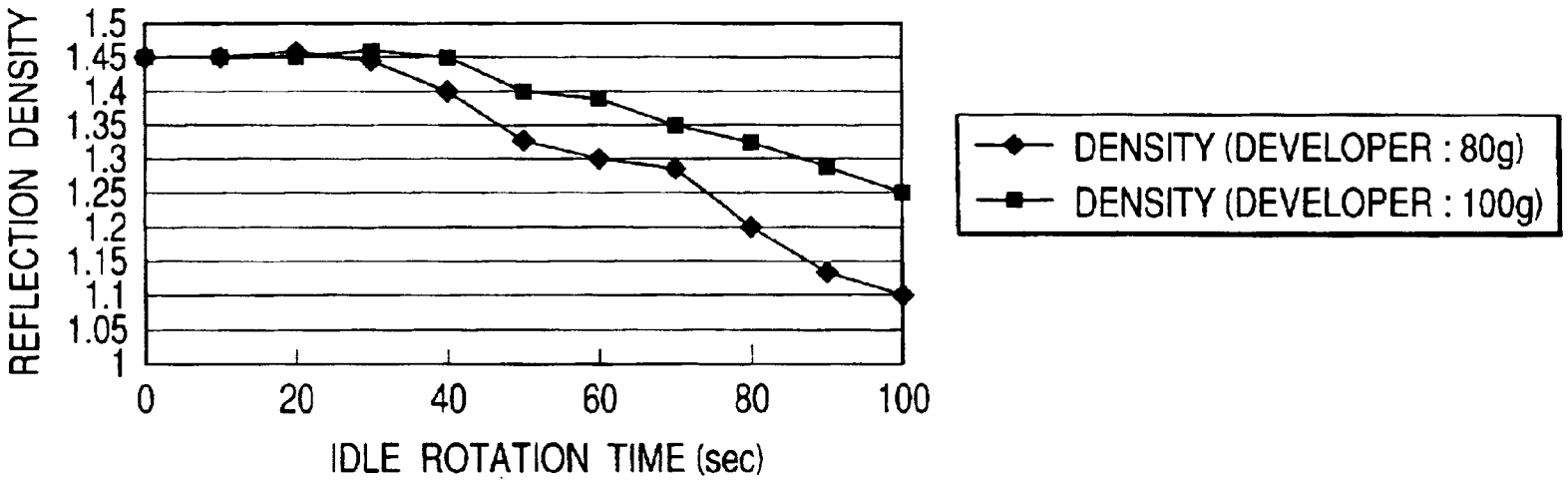
FIG. 12 is a chart showing a variation in the image density by an idle rotation at the developer replenishment.

However, in case a toner replenishing container is once taken out from the image forming apparatus and such used toner replenishing container is again mounted in the image forming apparatus, or in case the developer is absent by the replacement of the developing device, naturally the signal value does not increase, so that an idle rotation is executed for a maximum period in a state prior to the replenishment (namely in a state with a low amount of the developer). FIG. 11 shows a variation in the fog as a function of the idle rotation period, and FIG. 12 shows a similar variation in the density. An idle rotation gives rise to an excessive increase in the charge amount of the entire developer on the developer carrying member, by the friction with the developing blade. As a result, the developer having an inappropriate charge flies to a white area of the electrostatic latent image on the image bearing member, thus causing a fog in the image. Also a large amount of idle rotation causes an external additive, present on the developer carried on the image carrying member, to enter the interior of the developer particles, thereby causing a decrease in the image density.

An experiment shown in FIG. 11 indicates that, in case of a developer amount of 80 g, the fog increases six times and the density decreases by 20% by an idle rotation for 100 seconds, and that these influences becomes larger as the developer amount decreases.

Based on these results, it can be known that a decrease in the amount of the idle rotation (toner replenishment by driving the carrying member 23 without executing the image forming operation) is very important.

In consideration of the foregoing, the present invention proposes a 3-step detection method, in which a third reference signal is provided between the first reference signal and the second reference signal.

The amount of the developer in the developing device is judged in two steps, namely by at first executing a comparison whether the second reference signal is reached and then executing a comparison with the third reference signal. For example, by selecting a maximum idle rotation period of 30 seconds from the first reference signal to the third reference signal and a maximum idle rotation period of 20 seconds from the third reference signal to the second reference signal, the idle rotation is limited to 30 seconds at maximum even if the replenishment is executed with a container not containing the developer.

However, the above-described 3-step detection method encounters a drawback in case the induced voltage is lower than the first reference signal. For example in case of the installation of the image forming apparatus or in case of the replacement of the developing device, there is almost no developer in the developing device, whereby the induced voltage becomes far lower than the reference signal. In such situation, a prohibition is immediately displayed, whereby the developer replenishment is not realized, thus giving an unpleasant feeling to the user.

In consideration of the foregoing, there is proposed a 4-step detection method.

In the 4-step detection method, there is provided a fourth reference signal (reference signal for prohibiting the image forming operation) lower than the first reference signal. Such method is also based on a fact that, since an image forming job ranging from a state slightly higher than the first reference signal to a state lower than the first reference signal is rendered executable without interruption in the course of the job, the detection signal may become significantly lower than the first reference signal in case such image forming job includes a large amount of originals with a high image ratio. After the completion of such image forming job, there is executed a toner replenishing operation, namely an idle rotation. In case the detection signal still does not exceed the first reference signal and the developer is still deficient even after the idle rotation is executed (by driving the carrying member 23) for the predetermined maximum idle rotation period from a state where the image forming operation is prohibited, the idle rotation is suspended and there is executed a display that the image forming operation is prohibited. Also in case a state lower than the fourth reference signal exceeds the predetermined maximum idle rotation period, there is executed a display for prohibition and the image forming operation is forcedly terminated. As a result, the 4-step detection method allows to achieve sufficient developer replenishment in case of absence of the developer in the developing apparatus and still avoid unnecessary idle rotation, in comparison with the aforementioned 3-step detection method.

In the following there will be explained drawbacks encountered in a situation equal to or higher than the second reference signal.

In the 2-step detection method, the 3-step detection method or the 4-step detection method, the idle rotation (toner replenishment by driving the carrying member) is immediately terminated and the copying operation is enabled as soon as the induced voltage becomes equal to or higher than the second reference signal. However the induced voltage easily becomes lower than the second reference voltage if the developer is consumed in a large amount by copying an original of a high image ratio such as of a solid black image or an original locally including a high image ratio portion. In such situation, the aforementioned idle rotation is executed, whereby the copying operation cannot be executed for a while and the use can be frustrated.

Further, as will be seen in FIG. 6 explained in the foregoing, the detection method utilizing the antenna member shows some unevenness in the detection value even in case the position of the antenna member is optimized. The unevenness in the detection signal principally results from an SD gap which is the distance from the developer carrying member and the image bearing member, and a fluctuation in the distribution of the developer in the developing apparatus, caused by the agitating rod. In order to avoid such drawback, there is proposed a method employing the 4-step detection method and executing an idle rotation for a predetermined period at any time in case the induced voltage becomes lower than the second reference signal.

In the following there will be shown an example of the idle rotation period.

As will be apparent from FIG. 10, in case the developer shows a high level of cohesion, a replenishment for about 10 seconds increases the signal by 0.1 V and the developer amount by about 15 g. In case the signal is assumed to have a fluctuation of ±0.05 V, the margin for the developer amount becomes about 7.5 g. Stated differently, the signal value does not become less than the second reference signal even after passing several sheets bearing a solid black image (1 g/sheet). As a result, it is rendered possible to reduce the time in which the user cannot execute the copying operation. The above-mentioned values are merely an example, and there may exist optimum values for each image forming apparatus.

In the following, there will be explained Examples 1 and 2 as specific examples.

EXAMPLE 1

Figure 13:
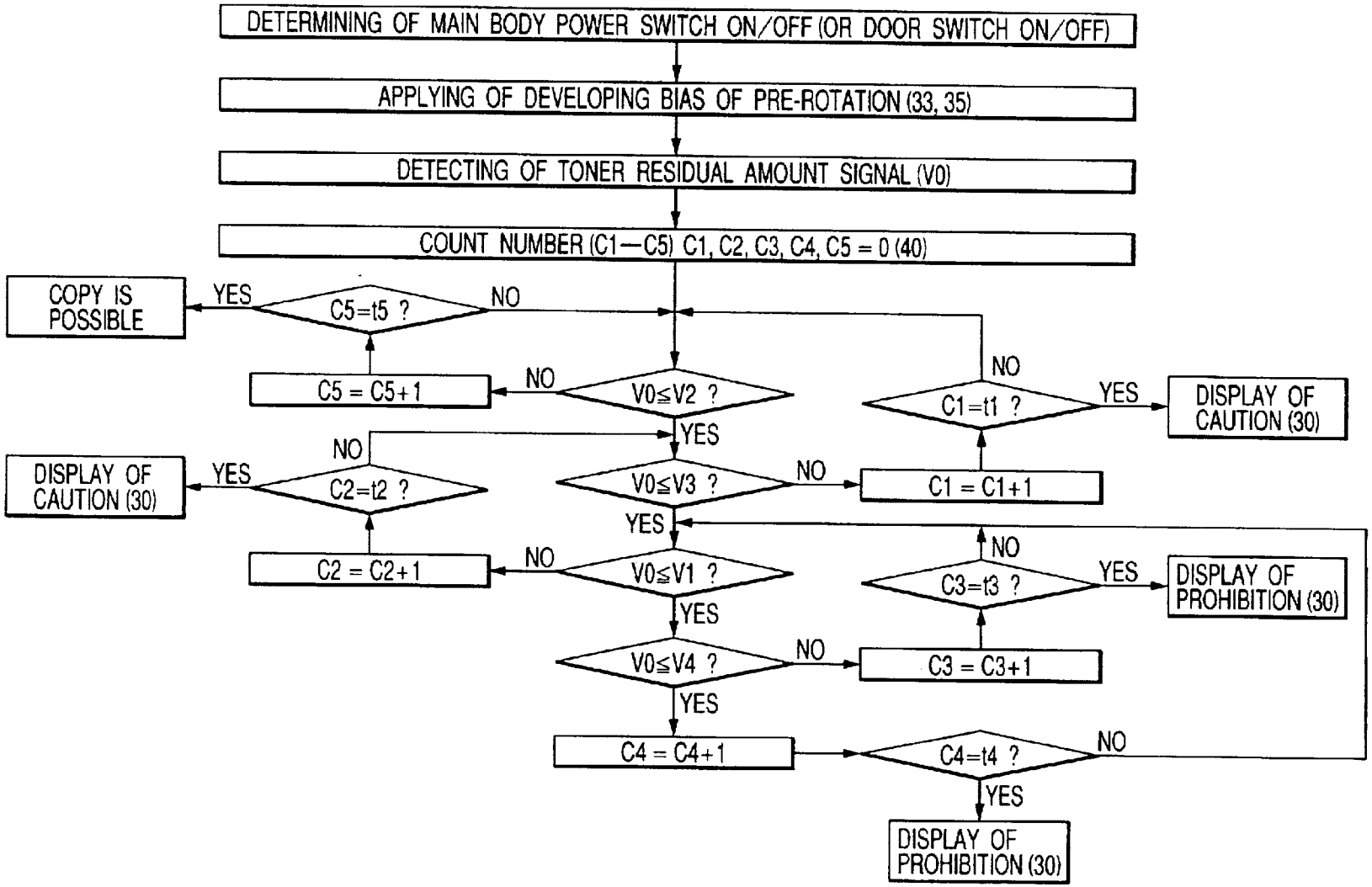
FIG. 13 is a flowchart of an embodiment 1.

FIG. 13 shows a flowchart of Example 1.

The present example employs the aforementioned 4-step detection method, in which the alarm judging means and the prohibition judging means are executed corresponding to the reference signal values.

For judging whether the developer container is attached or not, a memory apparatus or a mechanism for detecting the attaching or detaching of the developer container is generally used for judging the presence or absence of the developer replenishment. However, since such method is considerably costly, the developer replenishment is judged by a door switch or by an off/on operation of the power supply of the main body.

Then the developing biases 33, 35 are applied and the induced voltage is detected by the antenna member 26. Then the developer amount calculation means 36 converts the induced voltage into the aforementioned remainder detection signal V0 and compares it with the reference signal in the comparator circuit Q1. The comparison is executed in an order of the second reference signal, the third reference signal, the first reference signal and the fourth reference signal, and there is also judged whether the upper limit counts (t1–t4) in the respective signal ranges are reached.

The upper limit counts are defined in the following manner: t1 for a range $V3<V0\leqq V2$, t2 for a range $V1<V0\leqq V3$, t3 for a range $V4<V0\leqq V1$, and t4 for a range $V0\leqq V4$. For example, in case the toner is consumed by the image forming operation and the remaining amount of the toner in the developing device gradually decreases, if the induced voltage V0 is in a range: first reference signal $V1<V0\leqq$third reference signal V3, the value of a count C2 is increased by one. Then, when the count C2 reaches the upper count number t2, the alarm display 30 is executed. Also in case the induced voltage V0 is equal to or larger than the second reference signal V2, the replenishment is continued until a count number t5 is reached. In the present example, the alarm and the prohibition are executed in the display only and the copying operation is enabled, so that the stopping of the image forming means is determined by the discretion of the user.

In FIG. 10 showing a specific example of the example 1, the first reference signal V1 is selected as 2.05 V, the second reference signal V2 as 2.40 V, the third reference signal V3 as 2.10 V, and the fourth reference signal V4 as 1.9 V. Also the maximum alarm period t2 is selected as 60 seconds, t1 as 30 seconds, t3 as 120 seconds, t4 as 30 seconds and t5 as 10 seconds. As a result, the idle rotation period can be reduced by 30 seconds in comparison with the 2-step detection method, and, with the unevenness in the remaining amount of the developer at the replenishment ranging from 80 to 100 g, it is therefore possible to reduce the fog by 0.7% in average and to increase the density by 0.08 in average.

As explained in the foregoing, the present example allows, in comparison with the known technology, to exactly grasp the amount of the developer in the developing apparatus at the developer replenishment, and transmits the developer amount to the user thereby suppressing the increase in the image fog or the loss in the image density and also avoiding the erroneous detection immediately after the replenishment.

EXAMPLE 2

In the following there will be explained an example of stopping the image forming means at the display of the prohibition, thereby disabling the copying operation.

In the foregoing example 1, since the copying operation is enabled after the display of prohibition, the developer amount in the developing device before the developer replenishment fluctuates. Besides, since the developer amount is decreasing, there is a significant influence on the increase of the fog and on the decrease of the density.

Figure 14:
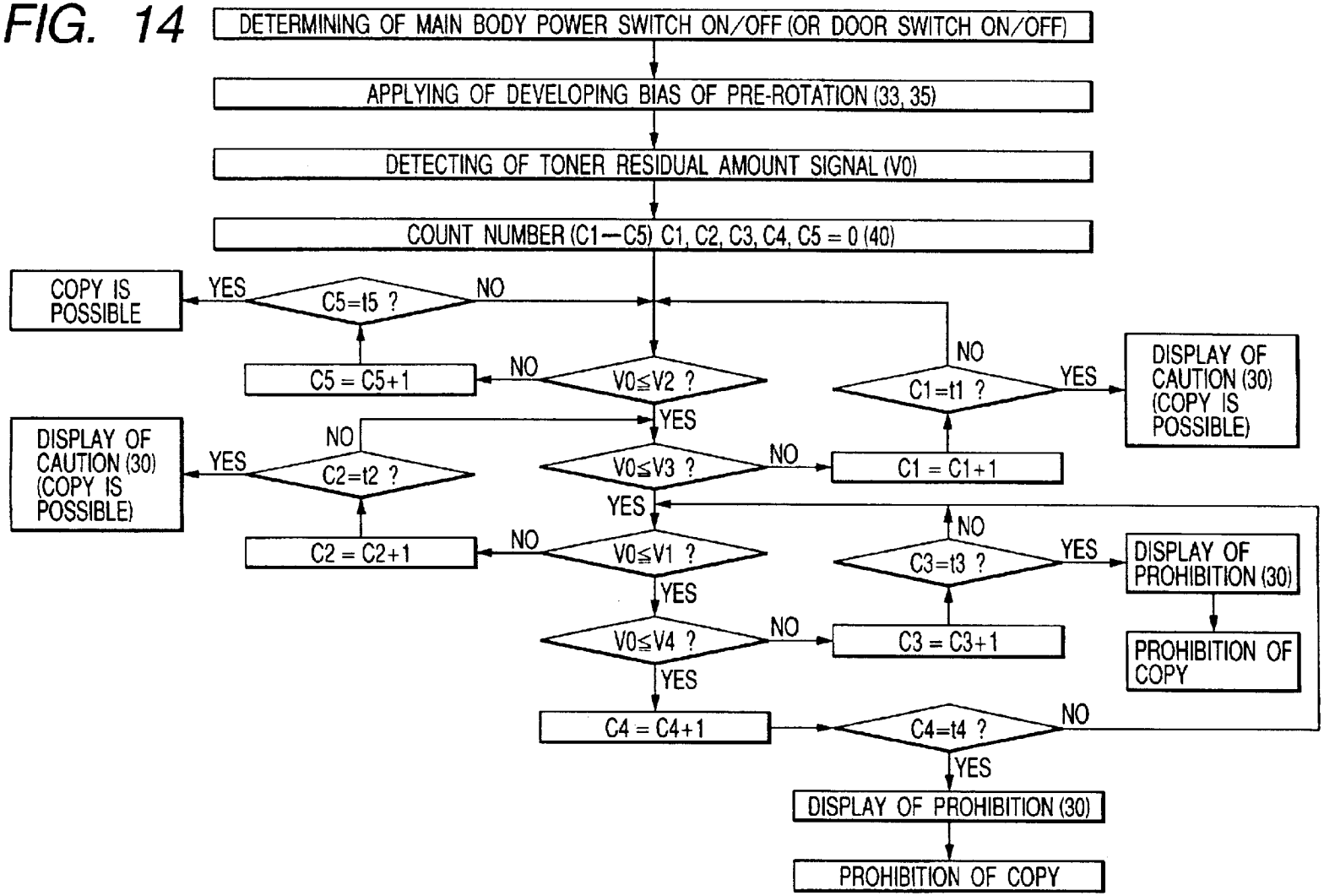
FIG. 14 is a flowchart of an embodiment 2.

FIG. 14 shows a flowchart of the present example 2.

In the present example 2, after the display of the prohibition, the image forming means is stopped to disable the copying operation. As a result, in comparison with the foregoing example 1, the unevenness in the developer amount immediately after the replenishment can be almost eliminated, so that, with a developer amount of 80 g, it is therefore possible to reduce the fog by 1.2% and to increase the density by 0.12 in comparison with a case of 80 g.

As explained in the foregoing, the above-described example stops the rotation of the developer carrying member in case the detection signal for the remaining amount of the developer does not reach the predetermined signal value within the predetermined period at the developer replenishment, thereby preventing the loss in the image density, the deterioration of the developer and the image fog.

Also in case the detection signal for the remaining amount of the developer does not reach the predetermined signal value within the predetermined period at the developer replenishment, there is given a display for requesting the replenishment, thereby more appropriately advising the presence or absence of the developer to the user.

Also in case the detection signal for the remaining amount of the developer reaches the predetermined signal value within the predetermined period at the developer replenishment, the developer is replenished further for a predetermined period, thereby reducing the period in which the copying operation cannot be executed.

What is claimed is:

1. An image forming apparatus comprising:

a developing device including a developer bearing member for developing, with toner, an electrostatic image formed on an image bearing member;

a toner replenishing container including toner for replenishment;

a carrying member for carrying the toner from said toner replenishing container to said developing device;

replenishing means for executing a toner replenishing operation by driving said developer bearing member and said carrying member;

detection means for detecting a remaining toner amount in said developing device; and control means for controlling a main body of the image forming apparatus according to an output of said detection means, wherein after detaching and attaching of the toner replenishing container, after opening and closing of a door of the main body, or after an off/on operation of a power supply of the main body, said control means executes the toner replenishing operation during a time according to the output of said detection means, wherein said control means emits an alarm for prohibiting an image forming operation, in a case that the output of said detection means, which is provided at a time when said toner replenishing operation as executed during the time according to the output of said detection means has terminated, is equal to or less than a first level, and wherein a time for executing a toner replenishing operation in a case that the output of said detection means is equal to or less than a second level, which is a level representing a smaller residual toner amount than the first level, is shorter than a time for executing a toner replenishing operation in a case that the output of said detection means is equal to or less than the first level and is larger than the second level.

2. An image forming apparatus according to claim 1, wherein said control means emits an alarm requesting the toner replenishing operation, in a case that the output of said detection means, which is provided at a time when the toner replenishing operation as executed during the time according to the output of said detection means has terminated, is equal to or less than a third level and is larger than the first level, the third level being a level representing a greater residual toner amount than the first level.

3. An image forming apparatus according to claim 2, wherein said control means emits an alarm requesting the toner replenishing operation, in a case that the output of said detection means, which is provided at a time when the toner replenishing operation as executed during the time according to the output of said detection means has terminated, is equal to or less than a fourth level and is larger than the first level, the fourth level being a level representing a smaller residual toner amount than the third level and a greater residual toner amount than the first level.

4. An image forming apparatus according to claim 3, wherein the image forming operation is executable when the alarm requesting the toner replenishing operation is emitted.

5. An image forming apparatus according to claim 3, wherein the image forming operation is executable when the alarm requesting the toner replenishing operation is emitted, and wherein the image forming operation is not executable when the alarm for prohibiting of the image forming operation is emitted.

6. An image forming apparatus according to claim 2, wherein the image forming operation is executable when the alarm requesting the toner replenishing operation is emitted.

7. An image forming apparatus according to claim 2, wherein the image forming operation is executable when the alarm requesting the toner replenishing operation is emitted, and wherein the image forming operation is not executable when the alarm for prohibiting of the image forming operation is emitted.

8. An image forming apparatus according to claim 2, wherein said control means emits an alarm that the image forming operation is possible, in a case that the output of said detection means, which is provided at a time when the toner replenishing operation as executed during the time according to the output of said detection means has terminated, is larger than the third level.

* * * * *